US009896750B2

(12) United States Patent
Lee et al.

(10) Patent No.: US 9,896,750 B2
(45) Date of Patent: Feb. 20, 2018

(54) STEEL WIRE ROD HAVING HIGH STRENGTH AND DUCTILITY AND METHOD FOR PRODUCING SAME

(71) Applicant: POSCO, Pohang-si (KR)

(72) Inventors: You-Hwan Lee, Pohang-si (KR); Chul-Min Bae, Pohang-si (KR); Geun-Soo Ryu, Pohang-si (KR)

(73) Assignee: POSCO, Pohang-si (KR)

( * ) Notice: Subject to any disclaimer, the term of this patent is extended or adjusted under 35 U.S.C. 154(b) by 363 days.

(21) Appl. No.: 14/419,587

(22) PCT Filed: Dec. 28, 2012

(86) PCT No.: PCT/KR2012/011750
§ 371 (c)(1),
(2) Date: Feb. 4, 2015

(87) PCT Pub. No.: WO2014/025105
PCT Pub. Date: Feb. 13, 2014

(65) Prior Publication Data

US 2015/0191805 A1 Jul. 9, 2015

(30) Foreign Application Priority Data

Aug. 9, 2012 (KR) ..... 10-2012-0087036

(51) Int. Cl.

| | |
|---|---|
| ***C22C 38/16*** | (2006.01) |
| ***C21D 8/06*** | (2006.01) |
| ***C22C 38/04*** | (2006.01) |
| ***C21D 6/00*** | (2006.01) |
| ***C21D 9/00*** | (2006.01) |
| ***C21D 9/52*** | (2006.01) |

(Continued)

(52) U.S. Cl.
CPC ..... *C22C 38/16* (2013.01); *C21D 6/005* (2013.01); *C21D 7/13* (2013.01); *C21D 8/06* (2013.01); *C21D 8/065* (2013.01); *C21D 9/0093* (2013.01); *C21D 9/525* (2013.01); *C22C 38/04* (2013.01); *B21C 1/00* (2013.01); *C21D 2211/001* (2013.01)

(58) Field of Classification Search
CPC ..... B21C 1/00; C21D 2211/001; C21D 6/005; C21D 7/13; C21D 9/525; C22C 38/04; C22C 38/16
USPC ..... 148/599
See application file for complete search history.

(56) References Cited

U.S. PATENT DOCUMENTS 7,794,552 B2 * 9/2010 Cugy ..... C21D 8/0205 148/337
2008/0240969 A1 10/2008 Kim et al.
2010/0253006 A1 10/2010 Ishikawa et al.
(Continued)

FOREIGN PATENT DOCUMENTS

CN 101248203 A 8/2008
CN 101568660 A 10/2009
(Continued)

*Primary Examiner* — Jie Yang
(74) *Attorney, Agent, or Firm* — The Webb Law Firm

(57) ABSTRACT

There are provided a steel wire rod for ultra-high-strength parts such as automobile engine bolts or structural mechanical parts, and a method for producing the steel wire rod. The steel wire rod having high strength and ductility includes, by wt %, carbon (C): 0.7% to 0.9%, manganese (Mn): 13% to 17%, copper (Cu): 1% to 3%, and the balance of iron (Fe) and inevitable impurities.

7 Claims, 1 Drawing Sheet

(51) Int. Cl.

| | |
|---|---|
| ***C21D 7/13*** | (2006.01) |
| *B21C 1/00* | (2006.01) |

(56) References Cited

U.S. PATENT DOCUMENTS

| | | | |
|---|---|---|---|
| 2012/0118443 | A1 | 5/2012 | Lee et al. |
| 2012/0128524 | A1 | 5/2012 | Chun et al. |
| 2013/0022491 | A1 | 1/2013 | Oura et al. |
| 2013/0133789 | A1 | 5/2013 | Okonogi et al. |

FOREIGN PATENT DOCUMENTS

| | | | |
|---|---|---|---|
| CN | 101984121 | A | 3/2011 |
| JP | S54-116322 | A | 9/1979 |
| JP | 09-085372 | | 3/1997 |
| JP | 2001-011579 | | 1/2001 |
| JP | 2003-334607 | | 11/2003 |
| JP | 2005-002413 | | 1/2005 |
| JP | 2011-225990 | A | 11/2011 |
| JP | 2012-41587 | | 3/2012 |
| KR | 10-2010-0050037 | A | 5/2010 |
| KR | 10-2011-0013889 | A | 2/2011 |
| KR | 10-1091511 | | 12/2011 |
| KR | 10-2012-0054941 | | 5/2012 |
| NO | 2009/069762 | A1 | 6/2009 |
| WO | 2007/024092 | A1 | 3/2007 |
| WO | 2008/078962 | A1 | 7/2008 |

* cited by examiner

【Figure 1】
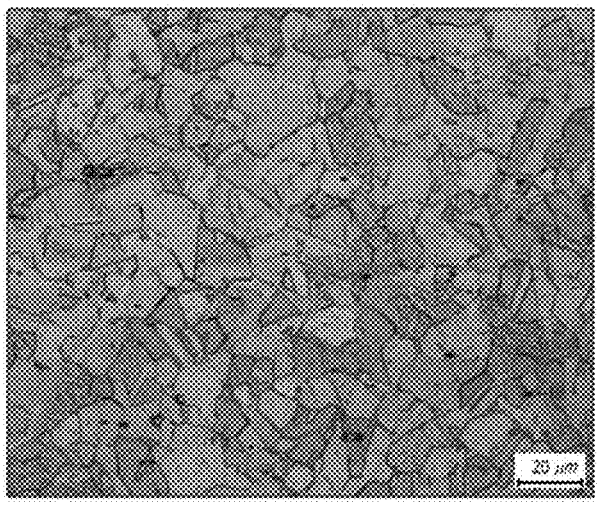
【Figure 2】
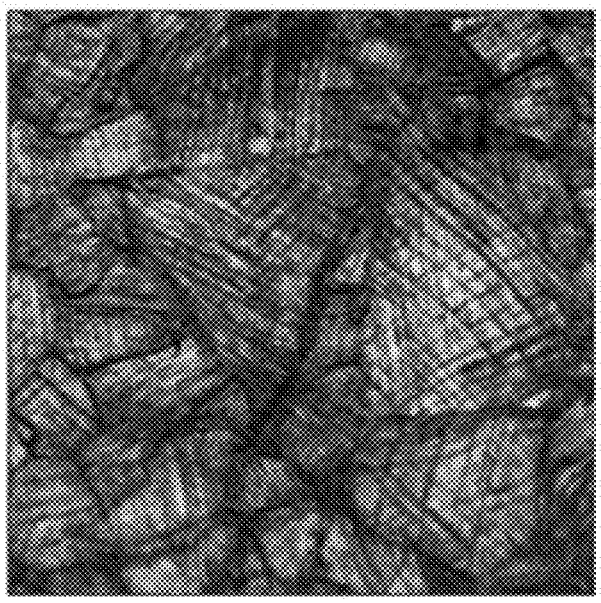

STEEL WIRE ROD HAVING HIGH STRENGTH AND DUCTILITY AND METHOD FOR PRODUCING SAME

CROSS-REFERENCE TO RELATED APPLICATIONS

This application is the United States national phase of International Application No. PCT/KR2012/011750 filed Dec. 28, 2012, and claims priority to Korean Patent Application No. 10-2012-0087036 filed Aug. 9, 2012, the disclosures of which are hereby incorporated in their entirety by reference.

TECHNICAL FIELD

The present disclosure relates to a steel wire rod for ultra-high-strength parts such as automobile engine bolts or structural mechanical parts, and a method for producing the steel wire rod.

BACKGROUND ART

Conventional high-strength steel wire rods or intermediate products of steel wire rods are generally produced by two methods. In the first of the two methods, a heat treatment process using a solder pot is performed once or twice on a steel wire rod between a hot rolling process and a cold drawing process, so as to increase the strength of the steel wire rod. This method is widely used to produce tire bead wires, and saw wires for cutting semiconductor wafers.

In the second of the two methods, a steel wire rod produced through a hot-rolling process is processed through quenching and tempering processes so as to have a desired degree of tensile strength.

The former method is usually used for producing narrow steel wire rods (having a diameter of about 0.1 mm to about 5 mm). That is, the former method is not suitable for producing steel wire rods for structural mechanical parts. Therefore, the latter method in which a desired degree of strength is obtained by heat treatments is usually used to produce steel wire rods for structural mechanical parts. Steel wire rods produced using quenching and tempering processes have mechanical characteristics determined by the heat treatments and alloying elements added thereto, and thus, such steel wire rods may be formed to have high tensile strength and ductility. However, large amounts of relatively expensive elements (such as molybdenum (Mo), vanadium (V), chromium (Cr), or nickel (Ni)) are added to the steel wire rods to guarantee the stability of the steel wire rods in terms of factors such as resistance to hydrogen delayed fracture, and thus manufacturing costs thereof may be increased.

Recently, automobiles have been required to be relatively lightweight while having high performance and energy saving features, and thus, parts such as bolts for driving units or engines are required to have high strength. Current high-strength bolts are formed of high-strength wire rods having a strength of about 1200 MPa and are formed through quenching and tempering processes by using alloy steels such as SCM435 or SCM440. However, since hydrogen delayed fracture may easily occur in steel wire rods having a tensile strength of 1200 MPa or greater, the usage of such steel wire rods is limited.

Most high-strength steel wire rods are formed of quenched and tempered steels by performing a hot-rolling process in order to form hot-rolled wire rods (intermediate products), and performing reheating, quenching and tempering processes on the hot-rolled wire rods. However, non-quenched and tempered steels may be used. Non-quenched and tempered steels may have levels of ductility and strength similar to those of heat-treated (quenched and tempered) steels even in the case that they are manufactured without performing a heat treatment process after a hot-rolling process. In Korea and Japan, such steels are known as "non-quenched and tempered steels." However, in countries such as Britain and the United States, such steels are called "non-heat-treated steels" because no heat treatment is performed thereon, or "micro-alloyed steels" because small amounts of alloying elements are added thereto.

Generally, processes for manufacturing steel wire rods using quenched and tempered steels include a hot-rolling process, a cold drawing process, a spheroidizing heat treatment process, a cold drawing process, a cold forging process, a quenching process, and a tempering process; while processes for manufacturing steel wire rods using non-quenched and tempered steels include a hot-rolling process, a cold drawing process, and a cold forging process. Therefore, steel wire rods formed of non-quenched and tempered steels are more economical owing to the low manufacturing costs thereof.

As described above, non-quenched and tempered steels are economical because heat treatment processes are omitted. In addition, since final quenching and tempering processes are not performed, defects such as bending caused by heat treatments are not present, and desired degrees of straightness are obtained. Therefore, many products are manufactured using non-quenched and tempered steels. However, due to the omission of heat treatments and the repetition of cold forming, the ductility of products is gradually decreased as processes proceed, even though the strength of products is increased.

A technique relating to this is disclosed in Patent Document 1. In Patent Document 1 (Japanese Patent Application Laid-open Publication No.: 2012-041587), a special steel having one or both of pro-eutectoid ferrite and bainite microstructures is proposed, and a quenched and tempered steel wire rod having a tempered martensite microstructure as a final microstructure is formed by heat-treating the special steel. According to Patent Document 1, a steel wire rod is manufactured by heating a slab having an alloying composition of carbon (C): 0.35 wt % to 0.85 wt %, silicon (Si): 0.05 wt % to 2.0 wt %, manganese (Mn): 0.20 wt % to 1.0 wt %, chromium (Cr): 0.02 wt % to 1.0 wt %, nickel (Ni): 0.02 wt % to 0.5 wt %, titanium (Ti): 0.002 wt % to 0.05 wt %, vanadium (V): 0.01 wt % to 0.20 wt %, niobium (Nb): 0.005 wt % to 0.1 wt %, and boron (B): 0.0001 wt % to 0.0060 wt %; rolling the slab to form a wire rod and cooling the wire rod; heating the wire rod to 750° C. to 950° C.; and processing the wire rod in a salt bath at a constant temperature of 400° C. to 600° C. Finally, the wire rod has a degree of strength within the range of 1500 MPa to 2000 MPa. According to the technique disclosed in Patent Document 1, a final degree of strength is obtained through a heat treatment process. However, the technique is not useful because of the complex composition of the wire rod and the increase in manufacturing costs due to the heat treatment process.

Patent Document 2 (Japanese Patent Application Laid-open Publication No.: 2005-002413) discloses a steel wire rod in which hypereutectoid pearlite having a pearlite interlayer gap of 200 μm to 300 μm is formed. The final strength of the steel wire rod is 4000 MPa to 5000 MPa. The steel wire rod is manufactured by producing an intermediate product through heating, wire rolling, and cooling, and performing first and second cold drawing processes and a lead patenting process on the intermediate product. The steel wire rod has an alloying composition of carbon (C): 0.8 wt % to 1.1 wt %, silicon (Si): 0.1 wt % to 1.0 wt %, manganese (Mn): 0.1 wt % to 1.0 wt %, chromium (Cr): 0.6 wt % or less, and boron (B): 0.005 wt % or less. However, the steel wire rod requires a drawing process up to about 0.18 mm, and thus, the steel wire rod is not suitable for use as a structural steel wire rod.

Patent Document 3 (Japanese Patent Application Laid-open Publication No.: 2011-225990) discloses a steel wire rod for a drawing process. The steel wire rod has a pearlite microstructure having 100 or fewer BN-based compounds and is processed through a cold forming process so that the steel wire rod may have a tensile strength of about 3500 MPa. The steel wire rod is manufactured by forming an intermediate product through heating to 100° C. to 1300° C., wire rolling, and cooling from 850° C. to 950° C. to 600° C. at a rate of 35° C./s. Then, a hot-rolling process, first and second cold drawing processes, and a lead patenting process are performed on the intermediate product to form the steel wire rod. Main alloying elements of the steel wire rod include carbon (C): 0.70 wt % to 1.2 wt %, silicon (Si): 0.1 wt % to 1.5 wt %, manganese (Mn): 0.1 wt % to 1.5 wt %, copper (Cu): 0.25 wt % or less, chromium (Cr): 1.0 wt % or less, boron (B): 0.0005 wt % to 0.001 wt %, and nitrogen (N): 0.002 wt % to 0.005 wt %. However, the steel wire rod requires a drawing process up to about 0.18 mm, and thus the steel wire rod is not suitable for use as a structural steel wire rod.

SUMMARY OF THE INVENTION

Aspects of the present disclosure may provide a steel wire rod for structural mechanical parts and a method for producing the steel wire rod, the steel wire rod being enhanced in strength and ductility through a cold drawing process without an additional heat treatment.

According to an aspect of the present disclosure, a steel wire rod having high strength and ductility may include, by wt %, carbon (C): 0.7% to 0.9%, manganese (Mn): 13% to 17%, copper (Cu): 1% to 3%, and the balance of iron (Fe) and inevitable impurities.

According to another aspect of the present disclosure, a method for producing a steel wire rod having high strength and ductility may include: reheating a steel ingot to a temperature of Ae3+150° C. to Ae3+250° C., the steel ingot including, by wt %, carbon (C): 0.7% to 0.9%, manganese (Mn): 13% to 17%, copper (Cu): 1% to 3%, and the balance of iron (Fe) and inevitable impurities; cooling the reheated steel ingot and hot-rolling the cooled steel ingot within a temperature range of Ae3+50° C. to Ae3+150° C., so as to form a hot-rolled wire rod; cooling the hot-rolled wire rod to a temperature of 600° C. or lower at a cooling rate of 1° C./s to 5° C./s; and cold-drawing the cooled hot-rolled wire rod at an area reduction ratio of 60% to 80% so as to form a steel wire rod.

According to the present disclosure, a steel wire rod for ultra-high-strength, high-ductility parts such as automobile engine bolts or structural mechanical parts is provided by using a cold drawing process.

BREIF DESCRIPTION OF THE DRAWINGS

FIG. 1 is an image illustrating the microstructure of a hot-rolled wire rod according to an exemplary embodiment of the present disclosure; and FIG. 2 is an image illustrating the microstructure of the hot-rolled wire rod of FIG. 1 after a final cold drawing process is performed on the hot-rolled wire rod.

DETAILED DESCRIPTION OF THE INVENTION

In the present disclosure, the term "steel wire rod"refers to a final product obtained after the completion of a cold drawing process, and the term "hot-rolled wire rod"refers to a wire rod obtained through a hot rolling process. In addition, a product obtained by cooling a hot-rolled wire rod is referred to as an intermediate product.

Hereinafter, a steel wire rod will be described in detail according to an exemplary embodiment of the present disclosure. First, the composition of the steel wire rod will be described in detail according to the exemplary embodiment of the present disclosure (hereinafter, percent (%) refers to wt %).

Carbon (C): 0.7% to 0.9%

In the exemplary embodiment of the present disclosure, if the content of carbon (C) in the steel wire rod is less than 0.7%, twins of the steel wire rod may not behave in desired manner, and thus it may be difficult to obtain desired strength and ductility. That is, if the carbon content of the steel wire rod is low, stacking fault energy (SFE) decreases during multiplication of dislocation or deformation, and thus ϵ-martensite may be formed during a cold drawing process or a cold forming process. If ϵ-martensite is formed during a forming process, the strength of the steel wire rod may become lower than a degree of strength obtainable by twins, and the ductility of the steel wire rod may be steeply decreased. On the other hand, if the content of carbon (C) in the steel wire rod is greater than 0.9%, excessive carbon (C) may increase the possibility of carbide formation at grain boundaries during a cooling process. If carbides are formed at grain boundaries, grain boundary embrittlement may occur, resulting in a large decrease in the ductility of the steel wire rod. Therefore, the carbon content of the steel wire rod may be maintained to be equal to or lower than 0.9%.

Manganese (Mn): 13% to 17%

In the exemplary embodiment of the present disclosure, manganese (Mn) is dissolved in the microstructure of the steel wire rod to form a substitutional solid solution and is related to the stability of an austenite single phase structure. If the content of manganese (Mn) in the steel wire rod is less than 13%, although the rate of work hardening is increased, SFE is decreased, and thus the possibility of the formation of ϵ-martensite increases during a cold drawing process or a cold forming process. In addition, if the content of manganese (Mn) in the steel wire rod is greater than 17%, it is economically unfavorable, and the surface quality of the steel wire rod may be worsened due to severe internal oxidation occurring during a reheating process for hot-rolling. Therefore, it may be preferable that the content of manganese (Mn) in the steel wire rod be maintained to be within the range of 13% to 17%.

Copper (Cu): 1% to 3%

Copper (Cu) is a main element stabilizing austenite and considerably contributes to the formation of twins and the multiplication of dislocation during a cold drawing process. If the content of copper (Cu) in the steel wire rod is less than 1%, the effect of copper (Cu) is very low, and a cold drawing process may not be easily performed due to frequent breakages. On the other hand, if the content of copper (Cu) in the steel wire rod is greater than 3%, it is economically unfavorable, and unlike carbon (C), copper (Cu) causes a decrease in the tensile strength of the steel wire rod. Therefore, it may be preferable that the content of copper (Cu) in the steel wire rod be maintained to be equal to or less than 3%.

In addition, the steel wire rod includes iron (Fe) and inevitable impurities. In the exemplary embodiment of the present disclosure, the inclusion of other elements in the steel wire rod is not excluded. Impurities of raw materials or manufacturing environments may be inevitably included in steel during iron and steel making processes, and such impurities may not be removed from the steel wire rod. Those of skill in the iron and steel manufacturing field will understand the inclusion of inevitable impurities.

Such inevitable impurities include phosphorus (P) and sulfur (S). Phosphorus (P) and sulfur (S) will now be described.

Phosphorus (P): 0.035% or less, and sulfur (S): 0.040% or less

Phosphorus (P) segregates at grain boundaries and thus decreases the ductility of the steel wire rod. Therefore, it may be preferable that the upper limit of the phosphorous content in the steel wire rod be 0.035%. Sulfur (S) has a low melting point and segregates at grain boundaries, thereby decreasing the ductility of the steel wire rod and forming sulfides. Sulfides lower the resistance to delayed fracture and worsen stress relaxation characteristics of the steel wire rod. Therefore, it may be preferable that the upper limit of the sulfur content in the steel wire rod be 0.040%.

According to the exemplary embodiment of the present disclosure, after a hot-rolling process, the steel wire rod (hot-rolled wire rod) may have an austenite single phase structure with a grain size of 10 μm to 100 μm. The austenite single phase structure formed in the hot-rolled wire rod by the hot-rolling process is maintained in an intermediate product obtained by cooling the hot-rolled wire rod. An example of the hot-rolled wire rod is illustrated in FIG. 1. FIG. 1 illustrates an austenite single phase structure having an average grain size of about 18 μm. The formation of twins is related to the size of grains. Thus, if the size of grains is less than 10 μm, twins may not be readily formed, and if the size of grains is greater than 100 μm, the ductility and fatigue characteristics of the steel wire rod may be worsened. Therefore, it may be preferable that the grain size be maintained to be within the range of 10 μm to 100 μm.

Preferably, the steel wire rod, a final product produced through a cold drawing process, may have a microstructure in which twins having a thickness of 10 nm to 50 nm are formed in an area fraction of 60% to 80%. FIG. 2 illustrates the microstructure of a steel wire rod obtained by performing a cold drawing process on the hot-rolled wire rod illustrated in FIG. 1 at a ratio of about 60%. Referring to FIG. 2, the steel wire rod is twinned (please refer to black bands within grains) while being work-hardened during the cold drawing process, and the area fraction of twins in the steel wire rod is within the range of 60% to 80%. If the amount of drawing is increased in the cold drawing process, the thickness and area fraction of internal twins are increased. However, if the amount of drawing is insufficient during the cold drawing process, the thickness and area fraction of twins of the steel wire rod may be outside of the above-mentioned ranges, and thus the strength of the steel wire rod may not have strength within a range proposed in the present disclosure. On the other hand, if the amount of drawing in the cold drawing process is excessive, the thickness and area fraction of twins of the steel wire rod may be excessively increased. In this case, although the steel wire rod may have a very high tensile strength, the ductility of the steel wire rod may be markedly decreased, and thus it may be difficult to form the steel wire rod into structural mechanical parts due to brittleness. Therefore, in the exemplary embodiment of the present disclosure, the thickness and area fraction of twins of the steel wire rod may be maintained to be within the above-mentioned ranges.

According to the exemplary embodiment of the present disclosure, the steel wire rod may have an ultra-high degree of strength within the range of 1800 MPa or greater and a high degree of ductility within the range of 15% or greater.

Hereinafter, a method for producing the steel wire rod will be described in detail according to an exemplary embodiment of the present disclosure.

A steel ingot having the above-mentioned composition is reheated. The steel ingot refers to a steel billet for forming a steel wire rod. Preferably, the reheating of the steel ingot may be performed within the temperature range of Ae3+150° C. to Ae3+250° C. for 30 minutes to one and a half hours.

Preferably, the temperature of reheating may be maintained to be within an austenite single phase temperature range equal to or higher than Ae3+150° C. so as to effectively dissolve remaining segregates, carbides, and inclusions. If the temperature of reheating is higher than Ae3+250° C., coarse austenite grains may be formed, and after cooling, a coarse microstructure may be finally formed. In this case, high strength and ductility may not be obtained.

In addition, if the period of reheating is shorter than 30 minutes, the temperature of the steel ingot may not become uniform. On the other hand, if the period of reheating is longer than one and a half hours, coarse austenite grains may be readily formed, and productivity may be markedly decreased.

Then, the reheated steel ingot is subjected to a cooling process and a hot-rolling process so as to produce a hot-rolled wire rod.

Preferably, the cooling process may be performed at a cooling rate of 5° C./s to 15° C./s. The cooling rate is proposed to minimize the transformation of the microstructure of the steel ingot during the cooling process performed before the hot-rolling process. Before the hot-rolling process, if the cooling rate is lower than 5° C./s, productivity may decrease, and an additional apparatus may be required to maintain the cooling rate at a low level. Furthermore, in this case, since the period of reheating is substantially extended, after the hot-rolling process, the hot-rolled wire rod may have relatively low strength and ductility. On the other hand, if the cooling rate is greater than 15° C./s, the steel ingot may have a large degree of driving force for transformation, and thus the possibility of formation of a new microstructure may be increased during the hot-rolling process. In this case, the temperature of the hot-rolling process may have to be reset.

Preferably, the hot-rolling process may be performed within the temperature range of Ae3+50° C. to Ae3+150° C. If the hot-rolling process is performed within the temperature range, the presence of a microstructure caused by deformation is suppressed, and recrystallization may not occur. That is, only the effect of sizing may be obtained through the hot-rolling process. If the temperature of the hot-rolling process is lower than Ae3+50° C., the temperature of the hot-rolling process is close to a dynamic recrystallization temperature, and thus grains may be elongated in the direction of hot rolling instead of being formed in a circular shape. Such elongated grains may cause undesired mechanical anisotropy. If the temperature of the hot-rolling process is higher than Ae3+150° C., the steel ingot is deformed due to high temperature, and thus even though dynamic recrystallization occurs, coarse grains may be formed due to rapid growth of grains at high temperature. Such coarse grains may also decrease the ductility of the hot-rolled wire rod, and an additional apparatus and energy may be required to cool the hot-rolled wire rod at a high cooling rate.

The hot-rolled wire rod is cooled to 600° C. or lower at a cooling rate of 1° C. to 5° C. (such a wire rod cooled after the hot-rolling process is an intermediate product). At the above-mentioned cooling rate, the diffusion of carbon may be effectively suppressed by manganese, and thus unnecessary carbides may not be formed along grain boundaries of single-phase austenite. If the cooling rate is lower than 1° C./s, the cooling rate is too low to perform the cooling process with practical productivity. In addition, carbides may be formed along grain boundaries, and thus the ductility of the wire rod may be lowered. On the other hand, if the cooling rate is greater than 5° C./s, the wire rod may undergo thermal deformation due to rapid cooling, and thus a coiling and cooling method which is a unique cooling method for steel wire rods may not be used. In addition, as is known, it is difficult to obtain a desired cooling rate when performing a cold forging process on general steel wire rods having a diameter (wire diameter) of 10 mm to 20 mm.

After the hot-rolled wire rod is cooled, a cold drawing process is performed on the cooled, hot-rolled wire rod to form a steel wire rod. The cold drawing process may be performed using a wedge-shaped cold drawing die to reduce the cross-sectional area of the hot-rolled wire rod and increase the tensile strength of the hot-rolled wire rod by the effect of work hardening.

The cold drawing process is performed using the cold forming die having a die angle of 10° to 13° for reducing the cross-sectional area of the hot-rolled wire rod and imparting cold forming characteristics to the hot-rolled wire rod. It may be preferable that the cold drawing process be performed at an area reduction ratio of 60% to 80%. The area reduction ratio is calculated based on an initial wire diameter and a wire diameter after the die as follows.

$$\text{Area reduction ratio} = 100 \times (\text{initial cross-sectional area} - \text{cross-sectional area after cold drawing}) / (\text{initial cross-sectional area})$$

In the exemplary embodiment of the present disclosure, if the area reduction ratio is less than 60%, it may be difficult to obtain a high degree of strength, for example, a tensile strength of 1800 MPa to 2100 MPa. On the other hand, if the area reduction ratio is greater than 80%, although a desired degree of tensile strength is obtained, the wire rod may be embrittled due to a large amount of cold forming, and thus breakage or fracture may occur.

[Mode for Invention]

Hereinafter, examples of the present disclosure will be described in detail. The following examples are for illustrative purposes only and are not intended to limit the scope of the present disclosure.

EXAMPLES

Steel ingots (billets) having compositions shown in Table 1 below were manufactured, and transformation points of the steel ingots were measured to about 910° C. Then, process temperatures were applied to the examples as follows. The steel ingots having the compositions shown in Table 1 below were reheated to about 1100° C., and were hot-rolled at about 1000° C. to form hot-rolled wire rods. The hot-rolled wire rods were cooled to about 520° C. at a cooling rate of about 3° C./s to form intermediate products.

Thereafter, the intermediate products were cold-drawn according to amounts of cold drawing (area reduction ratios) shown in Tables 2 and 3 so as to form steel wire rods, and the tensile strength and elongation of the steel wire rods were measured as shown in Tables 2 and 3.

TABLE 1

| Examples | C | Si | Mn | Cr | V | Al | Cu | Notes |
|---|---|---|---|---|---|---|---|---|
| *CE 1 | 0.82 | 0.25 | 0.7 | — | 0.05 | — | — | Conventional product for cold drawing |
| CE 2 | 0.92 | 0.25 | 0.7 | 0.2 | — | — | — | Conventional product for cold drawing |
| CE 3 | 0.6 | — | 18 | — | — | 1.5 | — | Al-containing commercial product |
| CE 4 | 0.9 | — | 15 | — | — | — | — | C—Mn based high manganese steel |
| CE 5 | 0.5 | — | 17 | — | — | — | 1.5 | Insufficient carbon content compared to inventive examples |
| CE 6 | 1.2 | — | 15 | — | — | — | 2.0 | Excessive carbon content compared to inventive examples |
| CE 7 | 0.8 | — | 10 | — | — | — | 1.5 | Insufficient manganese content compared to inventive examples |
| CE 8 | 0.8 | — | 20 | — | — | — | 1.5 | Excessive manganese content compared to inventive examples |
| CE 9 | 0.8 | — | 17 | — | — | — | 0.5 | Insufficient copper content compared to inventive examples |
| CE 10 | 0.9 | — | 13 | — | — | — | 4.0 | Excessive copper content compared to inventive examples |
| **IE 1 | 0.7 | — | 17 | — | — | — | 1.5 | Composition according to present disclosure |
| IE 2 | 0.8 | — | 17 | — | — | — | 1.5 | Composition according to present disclosure |
| IE 3 | 0.9 | — | 13 | — | — | — | 2.0 | Composition according to present disclosure |
| IE 4 | 0.9 | — | 13 | — | — | — | 3.0 | Composition according to present disclosure |

*CE: Comparative Example,
**IE: Inventive Example

TABLE 2

| Examples | Tensile strength (MPa) according to cold drawing amounts (%) 0 | 12 | 20 | 28 | 46 | 58 | 64 | 79 | Notes |
|---|---|---|---|---|---|---|---|---|---|
| *CE 1 | 1170 | 1236 | 1386 | 1423 | 1498 | 1568 | 1620 | 1685 | Insufficient strength |
| CE 2 | 1210 | 1298 | 1350 | 1463 | 1503 | 1571 | 1653 | 1691 | Insufficient strength |
| CE 3 | 802 | 1196 | 1302 | 1426 | X | — | — | — | Breakage during drawing |
| CE 4 | 882 | 1035 | 1298 | 1506 | X | — | — | — | Breakage during drawing |
| CE 5 | 920 | 1103 | 1236 | 1302 | 1468 | 1529 | 1690 | 1732 | Insufficient strength |
| CE 6 | 945 | X | — | — | — | — | — | — | Breakage during drawing |
| CE 7 | 889 | X | — | — | — | — | — | — | Breakage during drawing |
| CE 8 | 821 | 965 | X | — | — | — | — | — | Breakage during drawing |
| CE 9 | 886 | 1012 | X | — | — | — | — | — | Breakage during drawing |
| CE 10 | 801 | 1098 | 1169 | 1253 | 1405 | 1638 | 1789 | 1802 | Insufficient strength |
| **IE 1 | 842 | 1156 | 1418 | 1502 | 1652 | 1865 | 2109 | 2135 | Within inventive range |
| IE 2 | 853 | 1201 | 1369 | 1489 | 1752 | 1902 | 2122 | 2136 | Within inventive range |
| IE 3 | 882 | 1196 | 1356 | 1523 | 1625 | 1898 | 2109 | 2156 | Within inventive range |
| IE 4 | 896 | 1163 | 1374 | 1489 | 1698 | 1869 | 2112 | 2145 | Within inventive range |

*CE: Comparative Example,
**IE: Inventive Example

TABLE 3

| Examples | Maximum elongation (%) according to cold drawing amounts (%) 0 | 12 | 20 | 28 | 46 | 58 | 64 | 79 | Notes |
|---|---|---|---|---|---|---|---|---|---|
| *CE 1 | 17 | 11 | 9 | 8 | 9 | 8 | 8 | 8 | Insufficient ductility for structural mechanical parts |
| CE 2 | 16 | 14 | 10 | 9 | 8 | 8 | 6 | 7 | Insufficient ductility for structural mechanical parts |
| CE 3 | 76 | 58 | 40 | 32 | X | — | — | — | Breakage during drawing |
| CE 4 | 75 | 52 | 49 | 38 | X | — | — | — | Breakage during drawing |
| CE 5 | 81 | 72 | 60 | 40 | 32 | 21 | 19 | 16 | Sufficient ductility but insufficient strength |
| CE 6 | 52 | X | — | — | — | — | — | — | Breakage during drawing |
| CE 7 | 67 | X | — | — | — | — | — | — | Breakage during drawing |
| CE 8 | 72 | 35 | X | — | — | — | — | — | Breakage during drawing |
| CE 9 | 76 | 45 | X | — | — | — | — | — | Breakage during drawing |
| CE 10 | 81 | 71 | 59 | 45 | 32 | 19 | 18 | 15 | Sufficient ductility but insufficient strength |
| **IE 1 | 88 | 65 | 52 | 36 | 21 | 19 | 18 | 16 | Within inventive range |
| IE 2 | 88 | 67 | 56 | 38 | 23 | 20 | 18 | 15 | Within inventive range |
| IE 3 | 81 | 63 | 53 | 35 | 22 | 21 | 16 | 16 | Within inventive range |
| IE 4 | 86 | 58 | 49 | 39 | 19 | 18 | 17 | 15 | Within inventive range |

*CE: Comparative Example,
**IE: Inventive Example

Referring to Tables 2 and 3, inventive examples satisfying conditions of the present disclosure have high degrees of tensile strength equal to or greater than 1800 MPa and high degrees of elongation equal to or greater than 15%.

However, it is difficult to obtain ultra-high strength and high ductility from comparative examples which are commercially available products of the related art or products not including copper (Cu) and do not satisfy conditions of the present disclosure.

The invention claimed is:

1. A steel wire rod, the steel wire rod comprising, by wt %, carbon (C): 0.7% to 0.9%, manganese (Mn): 13% to 17%, copper (Cu): 1% to 3%, and the balance of iron (Fe) and inevitable impurities, wherein after a cold drawing process, the steel wire rod comprises twins having a thickness of 10 nm to 50 nm in an area fraction of 60% to 80%.

2. The steel wire rod of claim 1, wherein after a hot rolling process, the steel wire rod comprises an austenite single phase structure having a grain size of 10 μm to 100 μm.

3. The steel wire rod of claim 1, wherein the steel wire rod has a tensile strength of 1800 MPa or greater and an elongation of 15% or greater.

4. A method for producing a steel wire rod having high strength and ductility, the method comprising:

reheating a steel ingot to a temperature of Ae3+150° C. to Ae3+250° C., the steel ingot comprising, by wt %, carbon (C): 0.7% to 0.9%, manganese (Mn): 13% to 17%, copper (Cu): 1% to 3%, and the balance of iron (Fe) and inevitable impurities;

cooling the reheated steel ingot and hot-rolling the cooled steel ingot within a temperature range of Ae3+50° C. to Ae3+150° C., so as to form a hot-rolled wire rod;

cooling the hot-rolled wire rod to a temperature of 600° C. or lower at a cooling rate of 1° C./s to 5° C./s; and cold-drawing the cooled hot-rolled wire rod at an area reduction ratio of 60% to 80% so as to form a steel wire rod.

5. The method of claim 4, wherein the reheating of the steel ingot is performed for 30 minutes to one and a half hours.

6. The method of claim 4, wherein the cooling of the reheated steel ingot is performed at a cooling rate of 5° C./s to 15° C./s.

7. The method of claim 4, wherein the cold-drawing of the cooled and hot-rolled wire rod is performed using a cold-drawing die having a die angle of 10° to 13°.

* * * * *